US007195105B2

(12) United States Patent
Tygard

(10) Patent No.: US 7,195,105 B2
(45) Date of Patent: Mar. 27, 2007

(54) LIFT TRUCK

(75) Inventor: Edward Tygard, McMurray, PA (US)

(73) Assignee: Tygard Machine & Manufacturing Company, Washington, PA (US)

( * ) Notice: Subject to any disclaimer, the term of this patent is extended or adjusted under 35 U.S.C. 154(b) by 0 days.

(21) Appl. No.: 11/153,899

(22) Filed: Jun. 16, 2005

(65) Prior Publication Data

US 2006/0169540 A1 Aug. 3, 2006

Related U.S. Application Data

(60) Provisional application No. 60/580,719, filed on Jun. 21, 2004.

(51) Int. Cl.
*B66F 9/08* (2006.01)

(52) U.S. Cl. ..... 187/238; 187/222; 187/230; 187/237

(58) Field of Classification Search ..... 187/222, 187/230, 237, 238; 414/618, 632, 785
See application file for complete search history.

(56) References Cited

U.S. PATENT DOCUMENTS 1,625,290 A * 4/1927 Stockfleth et al. ..... 187/233
2,643,162 A * 6/1953 Barr ..... 384/58
2,915,210 A * 12/1959 Ehmann ..... 414/635
3,035,663 A * 5/1962 Mehlmann ..... 187/226
3,851,732 A * 12/1974 Wagner et al. ..... 187/238
3,999,267 A * 12/1976 Leskovec et al. ..... 29/898.03
4,124,104 A * 11/1978 Yarris ..... 187/238
4,139,111 A * 2/1979 Fritz ..... 414/607
4,264,252 A * 4/1981 Jennings et al. ..... 414/24.5
4,635,757 A * 1/1987 Yamagishi et al. ..... 187/230
5,046,585 A * 9/1991 Ohta et al. ..... 187/226

* cited by examiner

*Primary Examiner*—Eileen D. Lillis
*Assistant Examiner*—Eric E. Pico
(74) *Attorney, Agent, or Firm*—Michael Tobias

(57) ABSTRACT

A lift truck includes a guide member secured to a mast of the lift truck and a guided member secured to a carriage vertically movable along the mast. The guided member engages with the guide member to resist twisting moments acting on the carriage and enable the carriage to move smoothly along the mast. A clamping apparatus for use with the lift truck is engageable with the forks of the lift truck so that the weight of the clamping apparatus can be supported by the forks. A bracket mounted on the lift truck can be detachably connected to the clamping apparatus to prevent movement of the clamping apparatus in the fore-and-aft direction of the lift truck.

13 Claims, 19 Drawing Sheets

LIFT TRUCK

REFERENCE TO RELATED APPLICATIONS

This application claims the benefit of U.S. Provisional Application No. 60/580,719 filed on Jun. 21, 2004.

BACKGROUND OF THE INVENTION

This invention relates to a lift truck, and particularly to a lift truck capable of being used with a clamping apparatus for grasping a load from two or more sides.

A lift truck is a self-propelled vehicle equipped with a movable frame, referred to as a carriage, which can be raised and lowered along an upright mast. Various attachments, such as forks or clamps for supporting or grasping a load, can be mounted on the carriage so that the lift truck can raise and lower the load.

The carriage of a lift truck is usually equipped with rollers which roll along the inside of channels forming the mast. The engagement between the rollers and the channels enables the channels to resist forces acting on the carriage in the fore-and-aft direction of the lift truck, or moments acting on the carriage about an axis extending in the widthwise direction of the lift truck (such as can result from a load disposed in front of the lift truck). However, the channels have a much smaller ability to resist forces acting on the carriage in the widthwise direction of the lift truck, or moments acting on the carriage about an axis extending in the fore-and-aft direction of the lift truck (such as can result when a load being supported by the lift truck is spaced in the widthwise direction from the centerline plane of the lift truck, which is a vertical plane extending in the fore-and-aft direction of the lift truck and running through the widthwise center of the lift truck). Such a widthwise force or moment can cause the wheels of the carriage to be pressed against the channels or to become misaligned with the channels of the mast, making it difficult for the carriage to travel smoothly up and down the mast. In addition, because the rollers are typically made of a hard material such as steel, the misalignment can cause the rollers to gouge the channels, resulting in damage to the rollers and/or the channels.

SUMMARY OF THE INVENTION

The present invention provides a mast structure for a lift truck having improved ability to smoothly raise and lower a load, even when the center of gravity of the load is spaced from the centerline plane of the lift truck.

The present invention also provides a lift truck employing such a mast structure.

The present invention additionally provides a clamping apparatus which can easily be mounted on a lift truck.

According to one form of the present invention, a mast structure for a lift truck includes a mast, a carriage for supporting a load mounted on the mast, and a guide arrangement including a guide member secured to the mast and a guided member mounted on the carriage and engageable with the guide member as the carriage moves along the mast. The guide arrangement can resist forces acting on the carriage in a widthwise direction of a lift truck and moments acting on the carriage about an axis extending in a fore-and-aft direction of the lift truck.

There may be a single guided member, or a plurality of guided members may be spaced along the guide member. The guided member may be engageable with the guide member in various manners, such as by rolling contact or sliding contact. The mast structure can be mounted on various types of lift trucks.

According to another form of the present invention, a clamping apparatus for use with a lift truck includes a frame, a plurality of clamping arms mounted on the frame, and a pair of fork engaging members secured to the frame between two of the clamping arms. The clamping apparatus can be easily mounted on a lift truck by inserting forks of the lift truck into the fork engaging members.

In order to prevent the clamping apparatus from sliding along the forks of the lift truck during use, the lift truck may be equipped with a mounting bracket which is detachably engageable with the clamping apparatus.

According to yet another form of the present invention, a lift truck includes a truck body and a mast supported by the truck body. The mast includes first uprights disposed parallel to each other, second uprights disposed parallel to each other on opposite widthwise sides of the first uprights, and a guide member supported by one of the uprights for maintaining the first and second uprights parallel to each other. In a preferred embodiment, the guide member comprises a roller mounted on one of the uprights for rolling contact with another of the uprights and having a rotational axis extending in a fore-and-aft direction of the lift truck. The guide member prevents the first uprights from tilting with respect to the second uprights when a moment is applied to the first uprights and thereby allows the first uprights to smoothly translate along the second uprights.

DESCRIPTION OF PREFERRED EMBODIMENTS

Figure 1:
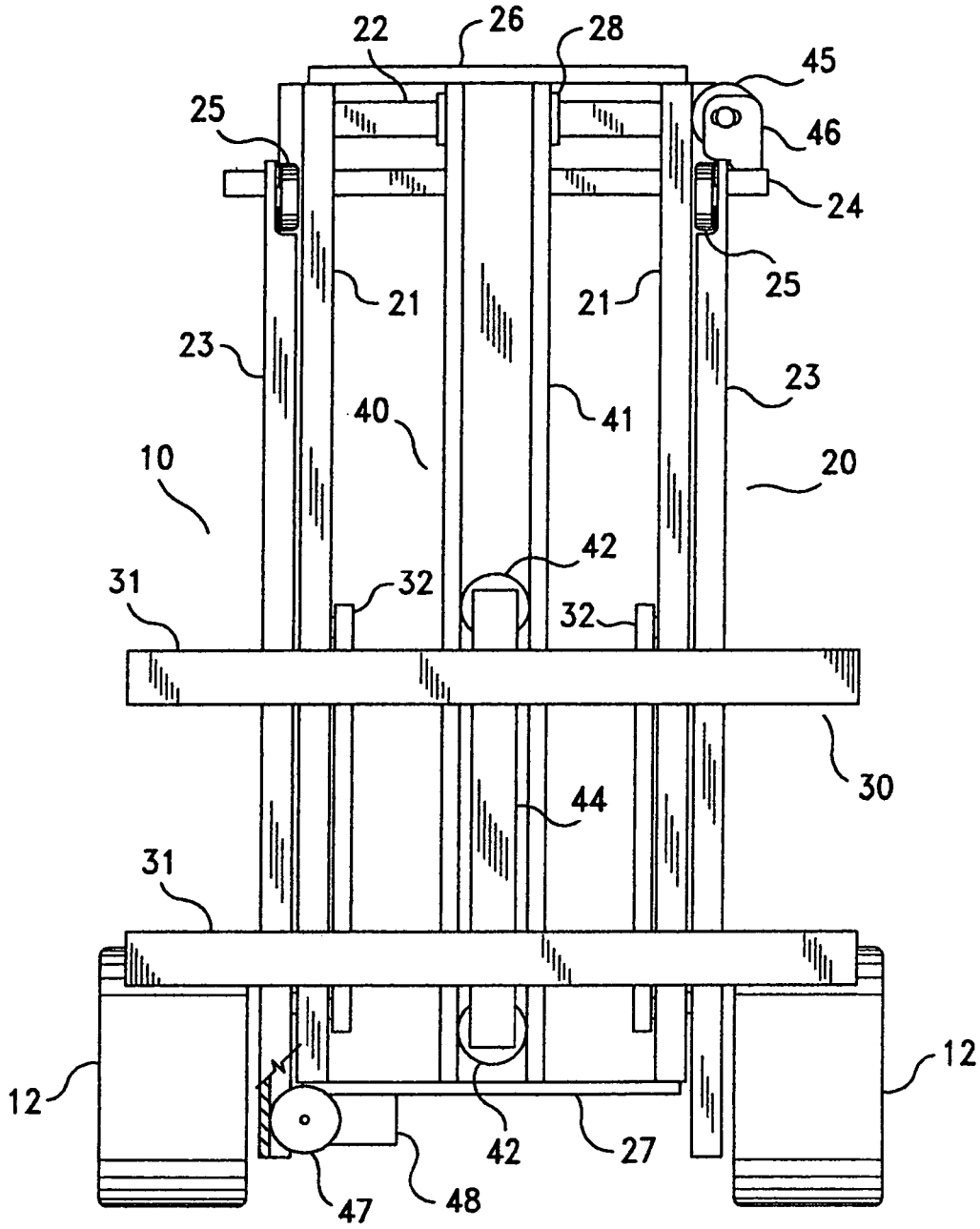
FIG. 1 is a schematic front elevation of an embodiment of a lift truck according to the present invention.
Figure 2:
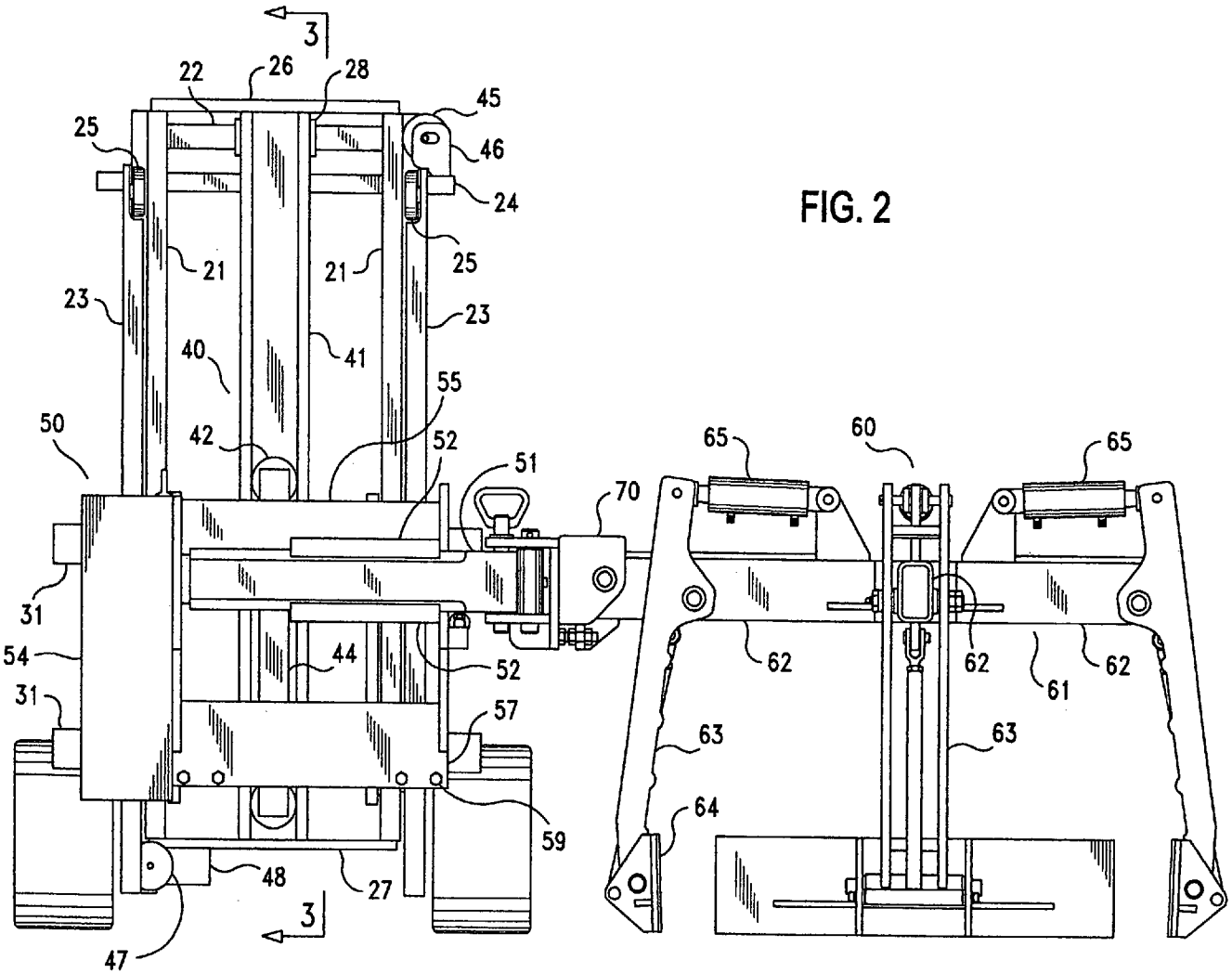
FIG. 2 is a schematic front elevation of the embodiment of FIG. 1 equipped with a side shifter and a clamping apparatus.
Figure 3:
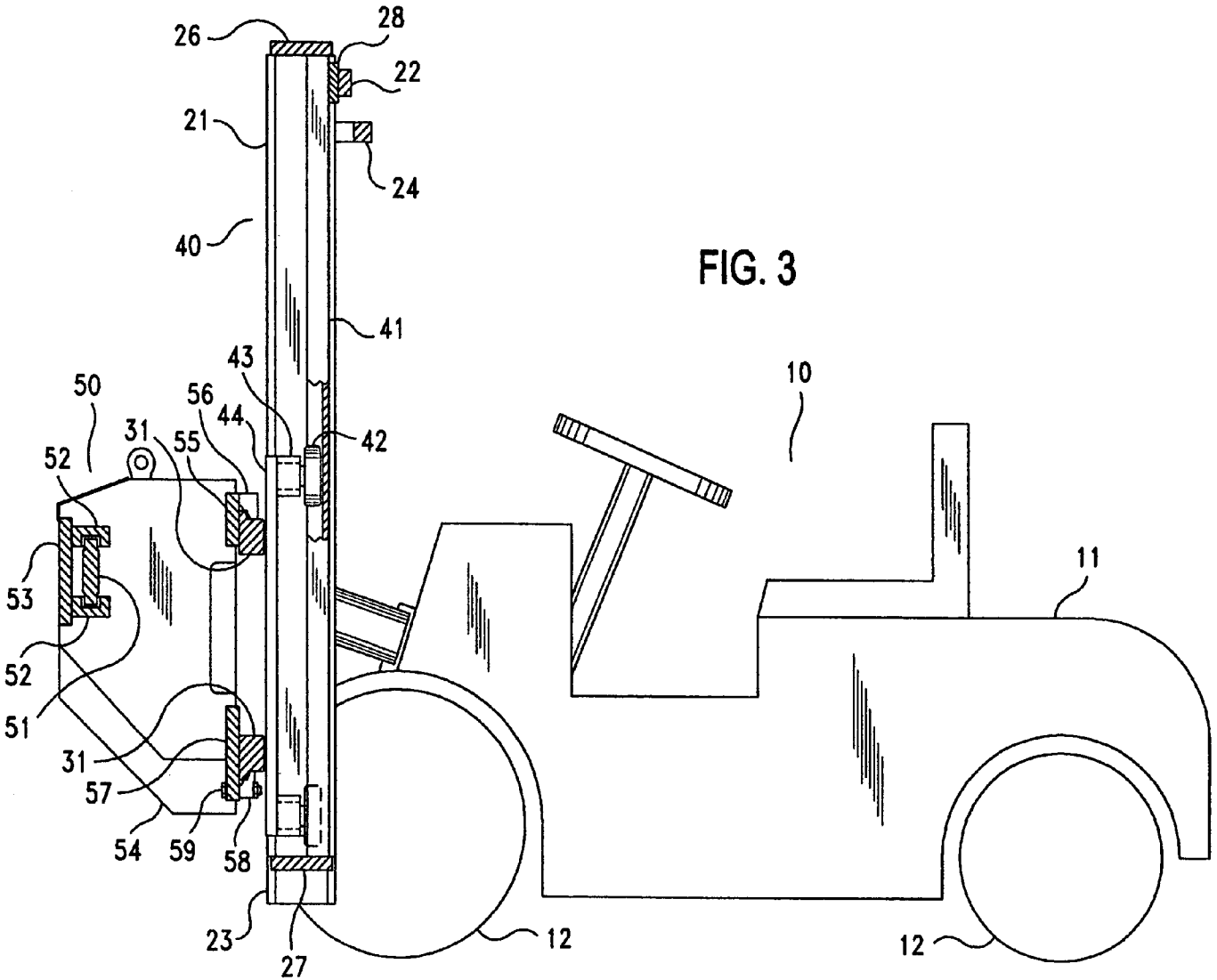
FIG. 3 is a schematic cross-sectional elevation taken along line 3—3 of FIG. 2.
Figure 4:
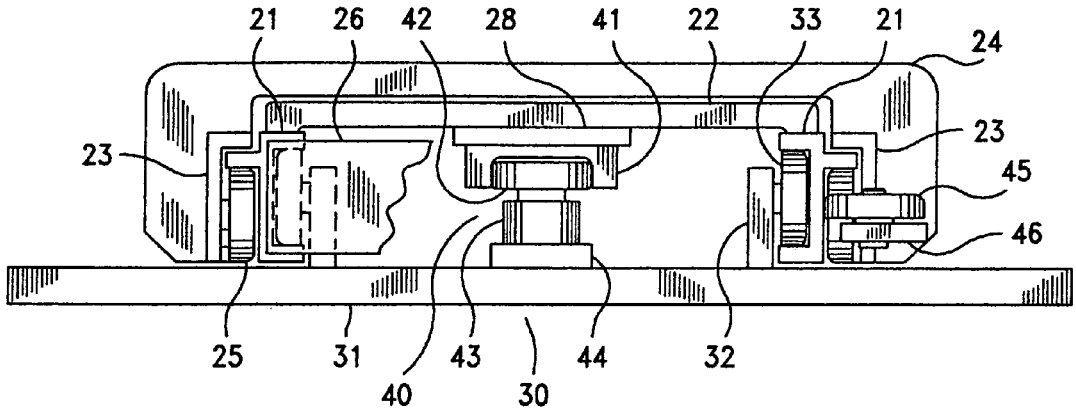
FIG. 4 is a schematic cutaway plan view of the mast of the embodiment of FIG. 1.

FIGS. 1–4 illustrate a first embodiment of a lift truck 10 according to the present invention. FIGS. 1 and 4 show the lift truck 10 without any attachments mounted on it, while FIGS. 2 and 3 illustrate the lift truck 10 equipped with a side shifter 50 and a clamping apparatus 60 for grasping a load. As shown in these figures, the lift truck 10 has a body 11 supported by a plurality of wheels 12 (four in the present embodiment). A mast 20 is mounted on the front of the body 11 in a conventional manner so that the angle of the mast 20 with respect to the vertical can be adjusted, and a carriage 30 is supported by the mast 20 for vertical movement along the mast 20. The illustrated mast 20 is what is commonly referred to as a two-stage mast, but it may instead be a one-stage mast or a mast with three or more stages. The overall structure of the mast 20 may be conventional. It includes a pair of inner channels 21, which are uprights disposed in parallel on opposite widthwise sides of the mast 20, and a pair of outer channels 23, which are uprights disposed in parallel on opposite widthwise sides of the inner channels 21. The inner channels 21 are connected to each other at their upper ends by a crosspiece 22 extending in the widthwise direction of the mast 20 on the rear side of the inner channels 21, and the outer channels 23 are connected with each other by a crosspiece 24 extending in the widthwise direction of the mast 20 to the rear of crosspiece 22. Additional unillustrated crosspieces for the inner channels 21 and outer channels 23 are disposed lower down on the mast 20. Rollers 25 are provided at the upper ends of the outer channels 23 for rolling contact with flanges of the inner channels 21, and unillustrated rollers are mounted near the lower end of the inner channels 21 for rolling contact with the interior of the outer channels 23 as the inner channels 21 are raised and lowered along the outer channels 23.

The carriage 30, which may also be of conventional structure, includes a pair of horizontal mounting bars 31 capable of supporting attachments commonly mounted on a lift truck such as lifting forks, a side shifter, or a clamping apparatus. The carriage 30 also includes a pair of vertical plates 32 which are secured to the mounting bars 31 and are equipped with rollers 33 (shown in FIG. 4) which can roll along the interiors of the inner channels 21 of the mast 20. The carriage 30 can be raised and lowered with respect to the inner channels 21 and the inner channels 21 can be raised and lowered with respect to the outer channels 23 by a conventional unillustrated lifting mechanism, which typically employs hydraulic cylinders which raise and lower the inner channels 21 with respect to the outer channels 23, and a chain and pulley system which raises and lowers the carriage 30 along the inner channels 21 as the inner channels 21 are raised and lowered along the outer channels 23. However, any other suitable type of lifting mechanism may instead be employed.

The engagement between the rollers 33 of the carriage 30 and the inner channels 21 can provide resistance to forces in the fore-and-aft direction of the carriage 30 and moments applied to the carriage 30 about an axis extending in the widthwise direction of the lift truck 10. However, the rollers 33 are not intended to resist forces applied to the carriage 30 in the widthwise direction of the lift truck 10 or moments applied to the carriage 30 about an axis extending in the fore-and-aft direction of the lift truck 10 (such as a moment due to a load which is supported by the carriage 30 with its center of gravity spaced in the widthwise direction of the lift truck 10 from the centerline plane of the lift truck). As stated earlier, if such lateral forces and moments are not resisted, they may cause the carriage 30 to become skewed with respect to the inner channels 21 and prevent the smooth movement of the carriage 30 along the inner channels 21. In addition, they may cause the rollers 33 to gouge the inner channels 21, resulting in damage to the rollers 33 and/or the inner channels 21. Therefore, in the present embodiment, the lift truck 10 is equipped with a guide arrangement 40 for the carriage 30 which can resist such lateral forces and moments. The guide arrangement 40 includes a guide member secured to the mast 20 between the inner channels 21, and one or more guided members secured to the carriage 30 and guided by the guide member in the lengthwise direction of the mast 20 as the carriage 30 moves along the mast 20. In this embodiment, the guide member comprises a guide channel 41 extending parallel to the inner channels 21, with the cavity formed between the flanges of the guide channel 41 facing towards the front of the lift truck 10, and the guided members comprise a pair of rollers 42 supported by the mounting bars 31 of the carriage 30. The guide channel 41 is shown disposed roughly midway between the inner channels 21 along the centerline plane of the lift truck 10. The guide channel 41 may be secured to any convenient portion of the mast 20. In the present embodiment, the upper and lower ends of the guide channel 41 are secured to an upper support plate 26 and a lower support plate 27 secured to the upper and lower ends, respectively, of the inner channels 21. Near its upper end, the guide channel 41 is also secured to the upper crosspiece 22 for the inner channels 21 through a support plate 28. Each roller 42 is rotatably mounted through a spacer 43 on a vertical support plate 44 which is secured to the rear side of the mounting bars 31 of the carriage 30. Each of the rollers 42 is loosely disposed between the inner surfaces of the flanges of the guide channel 41 with sufficient play that the rollers 42 can easily roll along the interior of the guide channel 41. However, the amount of play between the rollers 42 and the flanges of the guide channel 41 is sufficiently small that when a moment is applied to the carriage 30 about an axis normal to the plane of FIG. 1, i.e., about an axis extending in the fore-and-aft direction of the lift truck, such as by a load supported by the carriage 30 with its center of gravity spaced from the centerline of the lift truck 10, contact between the rollers 42 and the guide channel 41 can prevent the carriage 30 from twisting with respect to the inner channels 21 so that the rollers 33 of the carriage 30 can remain aligned with the inner channels 21 and smoothly roll along the inner channels 21. Contact between the rollers 42 and the guide channel 41 can also resist lateral forces acting on the carriage 30 in the widthwise direction of the lift truck 10. As a result of the guide arrangement 40, not only can the carriage 30 operate more smoothly, but wear and damage of the rollers 31 of the carriage 30 and the inner channels 21 are decreased. In the illustrated embodiment, both the guide channel 41 and the rollers 42 are made of steel, but they may be made of any other materials having a desired strength and wear resistance. The illustrated embodiment includes two rollers 42, but additional rollers may be installed at other locations on the support plate 44.

The guide member need not be in the form of a channel. For example, it may comprise an I-beam, and the rollers 42 may be disposed between the flanges of the beam. Alternatively, the guide channel 41 may be replaced by two angle irons disposed next to each other so as to together define generally the shape of a C as viewed from above, and the rollers 42 may be disposed between a leg of one of the angle irons and an opposing leg of the other angle iron.

Additional rollers may be provided to resist lateral forces and twisting moments so as to maintain the inner channels 21 substantially parallel to the outer channels 23. As shown in FIG. 1, in the present embodiment, an upper guide roller 45 is rotatably mounted on a bracket 46 secured to the upper crosspiece 24 for the outer channels 23 in rolling contact with or in close proximity to the outer surface of the web of the adjoining inner channel 21. In addition, a lower guide roller 47 is rotatably mounted on a bracket 48 secured to the lower support plate 27 for the guide channel 41 in rolling contact with or in close proximity to the inner surface of the web of the adjoining outer channel 23. These guide rollers 45 and 47, which each have a rotational axis extending in the fore-and-aft direction of the lift truck 10, can resist a clockwise moment acting on the inner channels 21 about an axis extending in the fore-and-aft direction of the lift truck 10 tending to cause the inner channels 21 to tilt with respect to the outer channels 23 and can thereby maintain the inner channels 21 parallel to the outer channels 23 so that the inner channels 21 can smoothly translate up and down along the outer channels 23. To enable the inner channels 21 to resist the application of a counterclockwise moment about an axis normal to the plane of FIG. 1, a roller corresponding to roller 45 can be installed at the upper end of the lefthand outer channel 23, and a roller corresponding to roller 47 can be installed at the lower end of the righthand inner channel 21 in FIG. 1.

This embodiment of a lift truck is not restricted to use with any particular type of equipment, and in general, it can be used with any type of attachment adapted for mounting on a lift truck, such as an attachment for lifting, grasping, or otherwise manipulating a load. By way of example, FIGS. 2 and 3 show the lift truck 10 of FIG. 1 equipped with a clamping apparatus 60 capable of grasping a load from two or more sides, and a side shifter 50 capable of translating the clamping apparatus 60 in the widthwise direction of the lift truck 10 to position the clamping apparatus 60 with respect to a load. The structure of the side shifter 50 and the clamping apparatus 60 are described in detail in U.S. patent application Ser. No. 10/689,848 entitled "Clamping Apparatus", the disclosure of which is incorporated by reference, so they will be described only briefly here.

The side shifter 50 includes a beam 51 slidably supported by a pair of guide channels 52 for movement in the widthwise direction of the lift truck 10. The guide channels 52 are secured to a mounting plate 53 (shown in FIG. 3 but omitted from FIG. 2 for clarity) which extends between opposite widthwise sides of the front of the side shifter 50. On one of its widthwise sides, the side shifter 50 may be equipped with a counterweight 54 for counterbalancing the weight of the clamping apparatus 60 and a load grasped by it. The beam 51 can be shifted in its lengthwise direction by an unillustrated actuator, such as a hydraulic cylinder. The side shifter 50 can be mounted on the mounting bars 31 of the carriage 30 of the lift truck 10 by an upper and lower mounting plate 55 and 57. The upper mounting plate 55 includes a pair of flanges 56 which fit over the upper mounting bar 31 of the carriage 30. A plurality of mounting clips 58 are adjustably secured to the lower end of the lower mounting plate 57 by bolts 59. The lower mounting bar 31 of the carriage 30 can be clamped between the lower mounting plate 57 and the mounting clips 58 by tightening the bolts 59.

The clamping apparatus 60 includes a cross-shaped frame 61 having four legs 62 on which are mounted a plurality of clamping arms 63 capable of pivoting with respect to the frame 61 to grasp and release a load. At its lower end, each clamping arm 63 is equipped with a contact portion 64 for contacting the side of a load. The clamping arms 63 can be pivoted on the frame 61 by suitable actuators, such as hydraulic cylinders 65.

The clamping apparatus 60 is connected to the beam 51 of the side shifter 50 by a connector 70 which enables the clamping apparatus 60 to pivot with respect to the side shifter 50 about a substantially horizontal axis and a substantially vertical axis. Pivoting of the clamping apparatus 60 about a substantially horizontal axis enables the attitude of the clamping apparatus 60 with respect to the lift truck 10 to be adjusted so that the clamping apparatus 60 can be maintained substantially level even when the lift truck 10 is on a sloping surface. Pivoting of the clamping apparatus 60 about a substantially vertical axis enables the clamping apparatus 60 to be pivoted between a position in front of the lift truck 10 and a position to the side of the lift truck 10. The structure of the illustrated connector 70 is described in detail in above-mentioned U.S. patent application Ser. No. 10/689,848.

Figure 5:
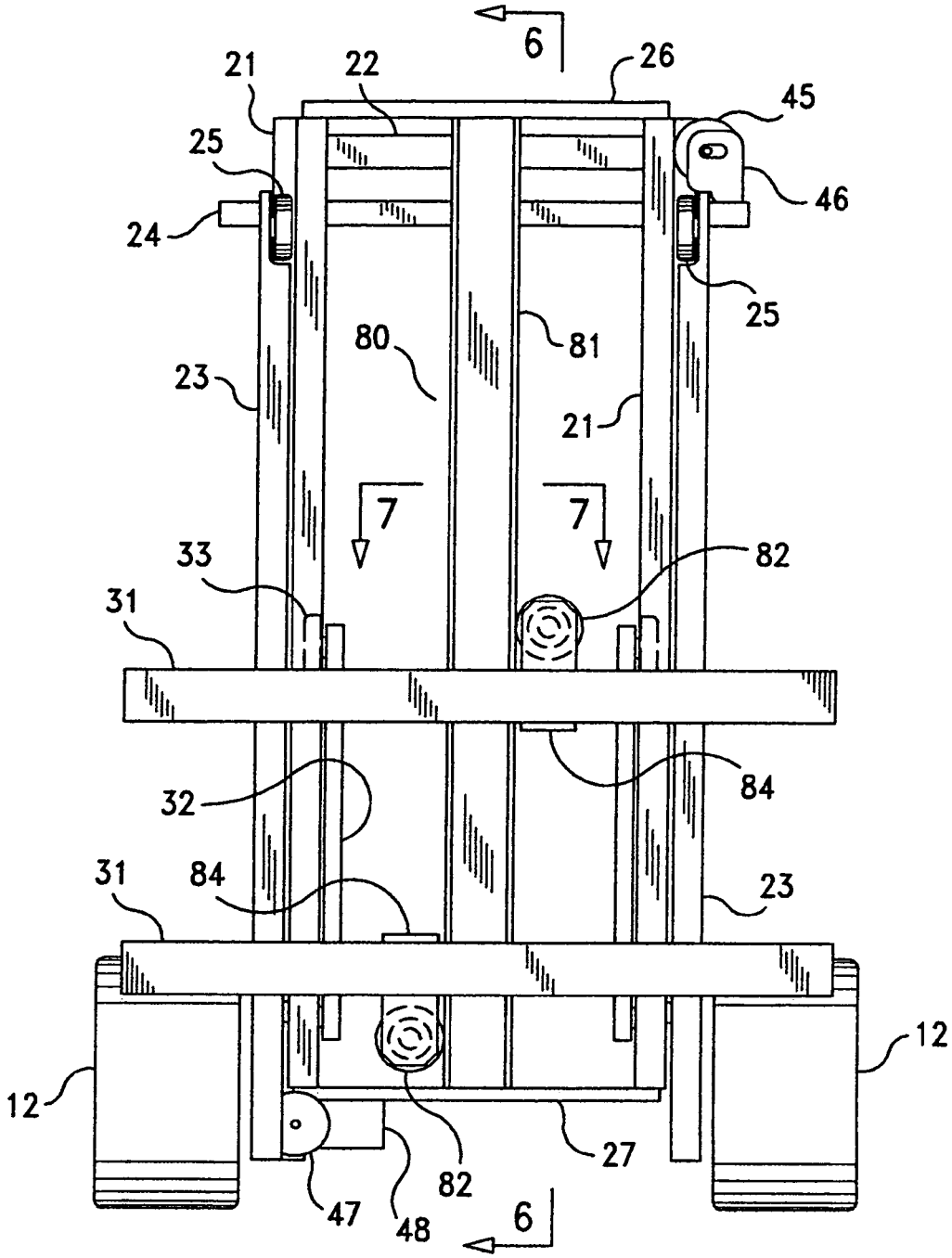
FIG. 5 is a schematic front elevation of another embodiment of a lift truck according to the present invention in which guide rollers move along the outside of a guide member.
Figure 6:
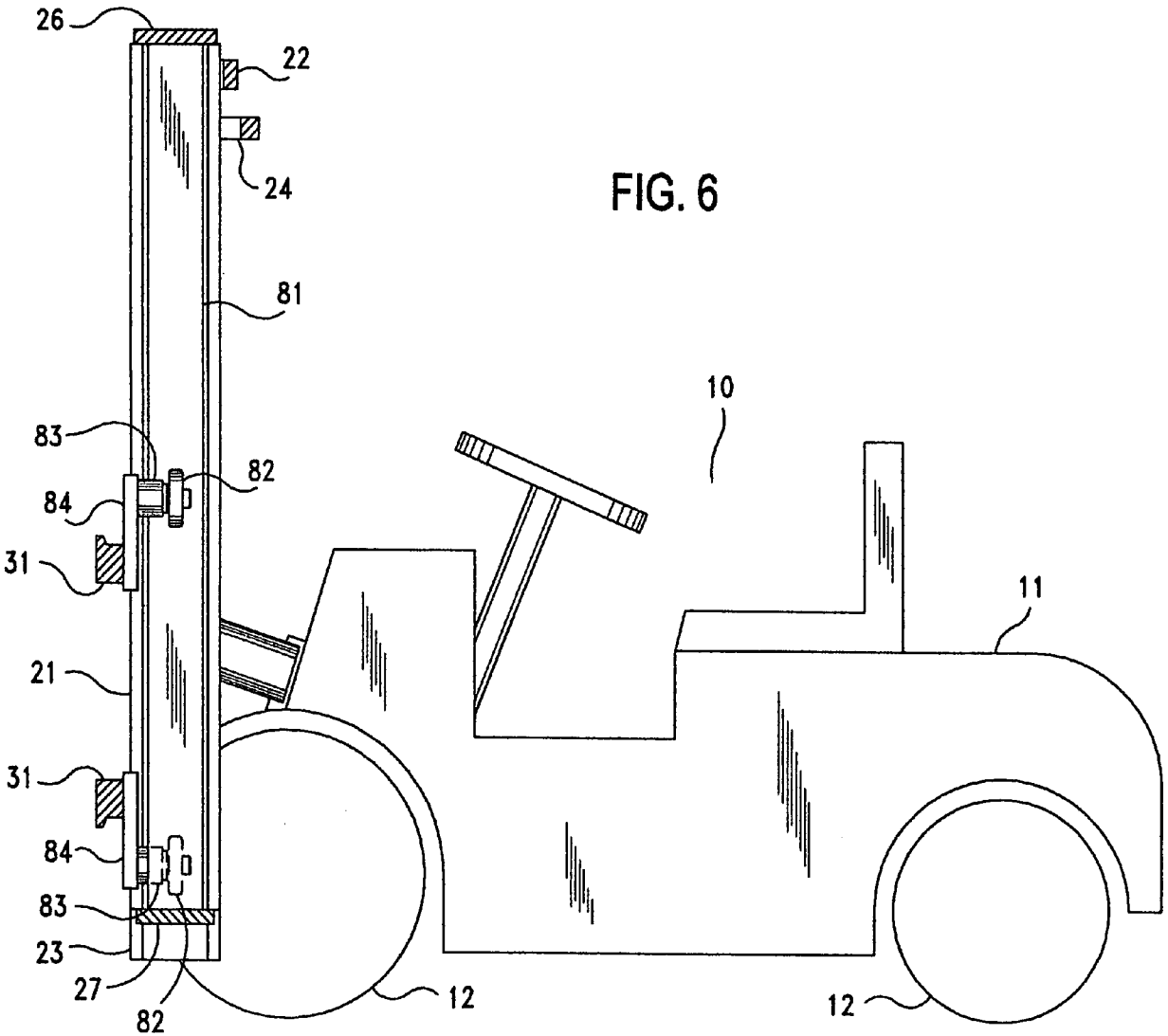
FIG. 6 is a schematic cross-sectional view taken along line 6—6 of FIG. 5.
Figure 7:
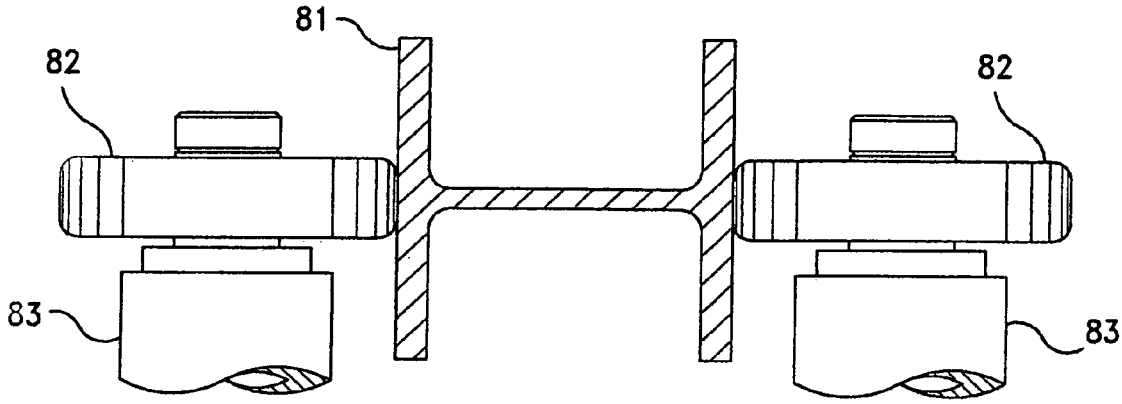
FIG. 7 is a schematic cross-sectional view taken along line 7—7 of FIG. 5.

Various other guide arrangements can be employed to resist lateral forces and moments acting on the carriage 30 to keep the rollers 33 of the carriage 30 in alignment with the inner channels 21 of the mast 20. FIGS. 5–7 illustrate another embodiment of a lift truck according to the present invention which includes a guide arrangement 80. FIG. 5 is a schematic front elevation of this embodiment, and FIGS. 6 and 7 are schematic cross-sectional views taken along lines 6—6 and 7—7, respectively, of FIG. 5. As shown in these figures, the guide arrangement 80 in this embodiment includes a guide member comprising an I-beam 81 secured to the upper and lower support plates 27 and 28 and extending parallel to the inner channels 21 along the centerline plane of the lift truck 10. The beam 81 is oriented such that the plane of its web extends in the widthwise direction of the lift truck 10. The guide arrangement 80 also includes guided members comprising a pair of rollers 82 disposed on opposite sides of the beam 81 in rolling contact with the flanges of the beam 81. Each roller 82 is rotatably mounted on a spacer 83 which is secured to a support plate 84 which is secured to one of the mounting bars 31 of the carriage 30. The beam 81 has a stiffness which is sufficient to keep the rollers 33 of the carriage 30 aligned with the inner channels 21 of the mast 20 when a transverse force or a moment about an axis extending in the fore-and-aft direction of the lift truck 10 acts on the carriage 30 during operation of the clamping apparatus 60. As a result, the carriage 30 is able to move smoothly up and down the mast 20 even when a transverse force is acting on the carriage 30 or when the clamping apparatus 60 is grasping a load which applies a moment to the carriage 30 about an axis extending in the fore-and-aft direction of the lift truck 10. The structure of this embodiment may be otherwise the same as that of the preceding embodiment. A side shifter 50 and clamping apparatus 60 like those shown in FIG. 2 may be mounted on the carriage of the lift truck 10 in the same manner as in the preceding embodiment.

This embodiment employs two guide rollers 82 for rolling engagement with the I-beam 81, but additional rollers may also be employed.

Figure 8:
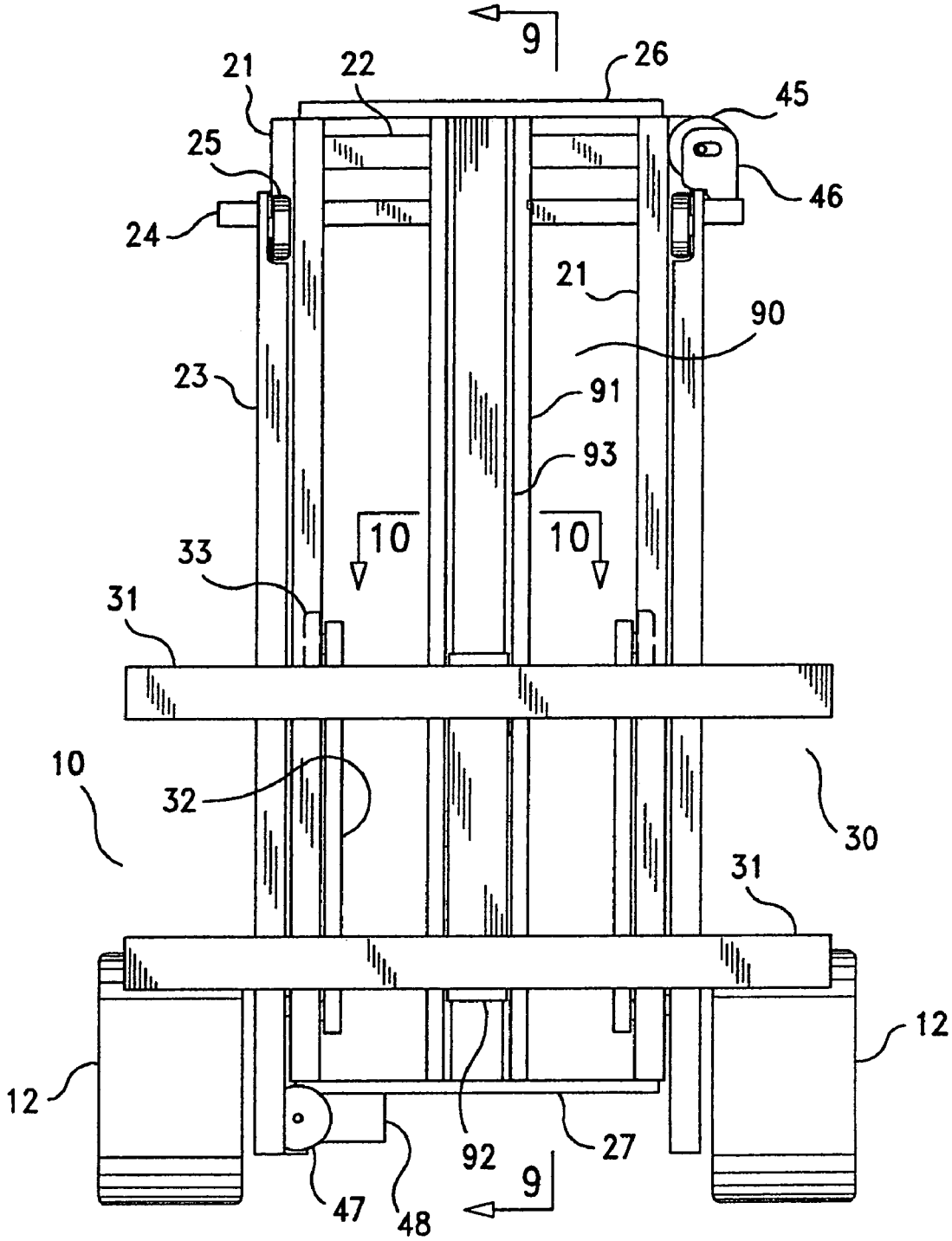
FIG. 8 is a schematic front elevation of another embodiment of a lift truck according to the present invention in which a guided member is in sliding engagement with a guide member.
Figure 9:
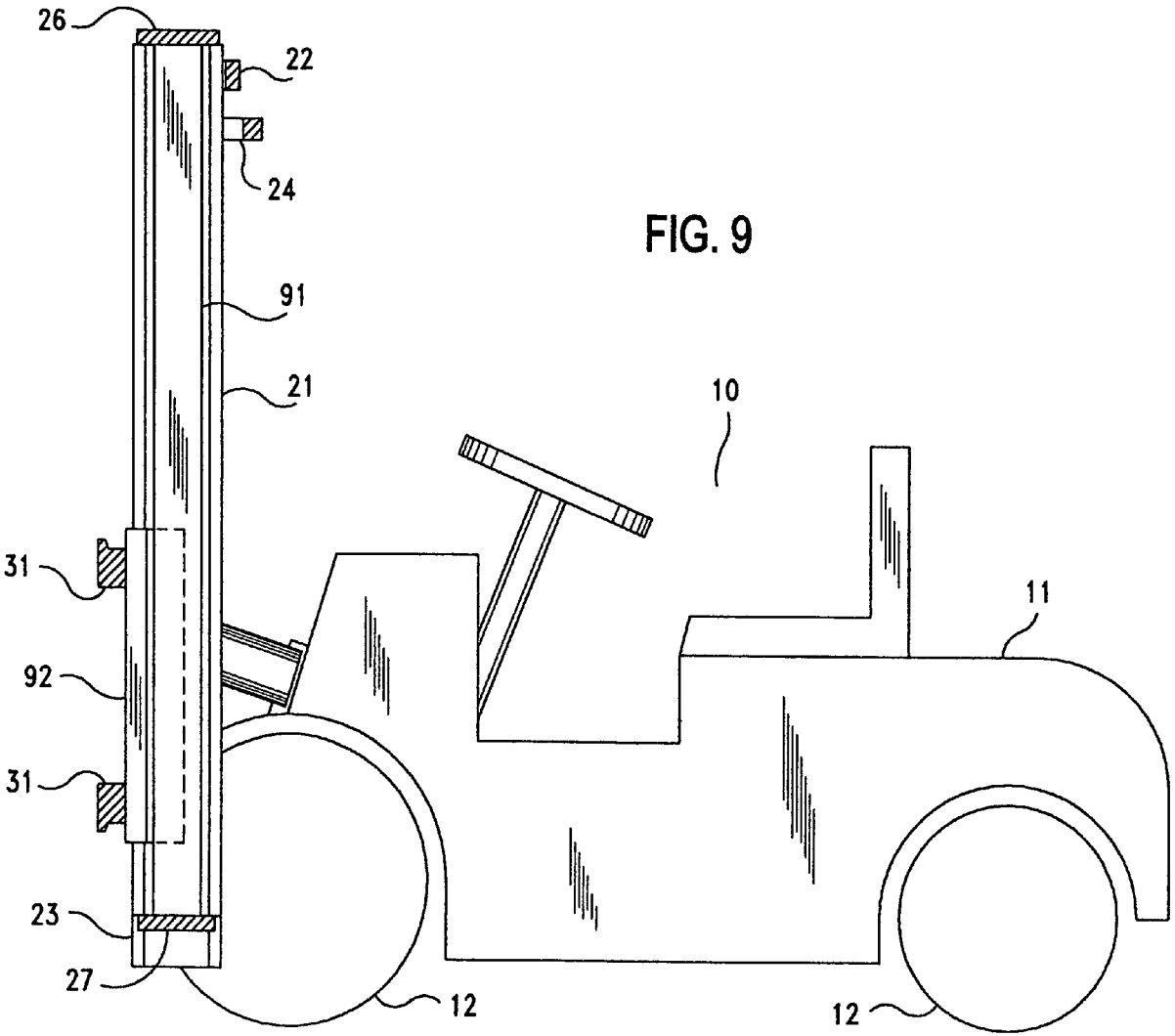
FIG. 9 is a schematic cross-sectional view taken along line 9—9 of FIG. 8.
Figure 10:
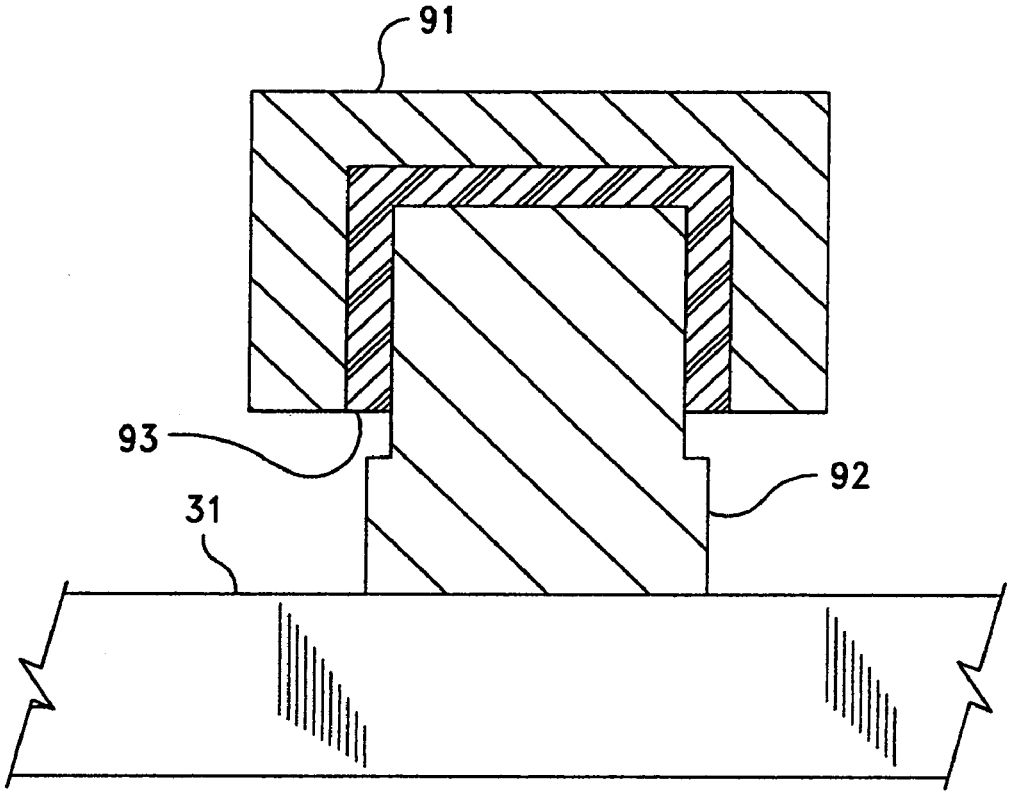
FIG. 10 is a schematic cross-sectional view taken along line 10—10 of FIG. 8.

FIGS. 8–10 illustrate another embodiment of a lift truck 10 according to the present invention equipped with a different guide arrangement 90. FIG. 8 is a schematic front elevation of this embodiment, and FIGS. 9 and 10 are schematic cross-sectional views taken along lines 9—9 and 10—10, respectively, of FIG. 8. The guide arrangement 90 in this embodiment includes a guide member comprising a guide channel 91 secured to the upper and lower support plates 26 and 27 and extending parallel to the inner channels 21 of the mast 20 of the lift truck 10, with the cavity formed between the flanges of the guide channel 91 facing towards the front of the lift truck 10. The guide arrangement also includes a guided member comprising a block 92 which is secured to the mounting bars 31 of the carriage 30 and slidably engages with the cavity in the guide channel 91. When a transverse force or a moment about an axis extending in the fore-and-aft direction of the lift truck 10 acts on the carriage 30, the engagement between the guide channel 91 and the block 92 prevents the block 92 and the carriage 30 to which it is secured from translating in the widthwise direction or twisting about the fore-and-aft axis and thereby keeps the rollers 33 of the carriage 30 aligned with the inner channels 21 of the mast 20 so that the carriage 30 can move smoothly up and down the mast 20. In order to allow smooth sliding movement of the block 91 along the guide channel 91 as the carriage 30 moves along the mast 20, one or both of the guide channel 91 and the block 92 may be at least partially made of or lined with a material having good sliding properties. In the present embodiment, the guide channel 91 and the block 92 are made of steel, and the cavity of the guide channel 91 is equipped with a C-shaped lining shoe 93 made of a material having good sliding properties. A wide variety of materials can be used to form the lining 93, including plastics such as nylon, polyethylene (such as ultra-high molecular weight polyethylene), polyesters, Teflon, and acetals, and metals such as oil-impregnated bronze.

A single block 92 may be secured to both mounting bars 31 of the carriage 30, or a separate block may be secured to each mounting bar 31, with each block engaging the guide channel 91.

Except for the structure of the guide arrangement 90, this embodiment may be otherwise the same as the preceding embodiments. Various attachments for use with a lift truck can be mounted on the carriage 30, such as a side shifter 50 and a clamping apparatus 60 in the same manner as shown in FIG. 2.

Figure 11:
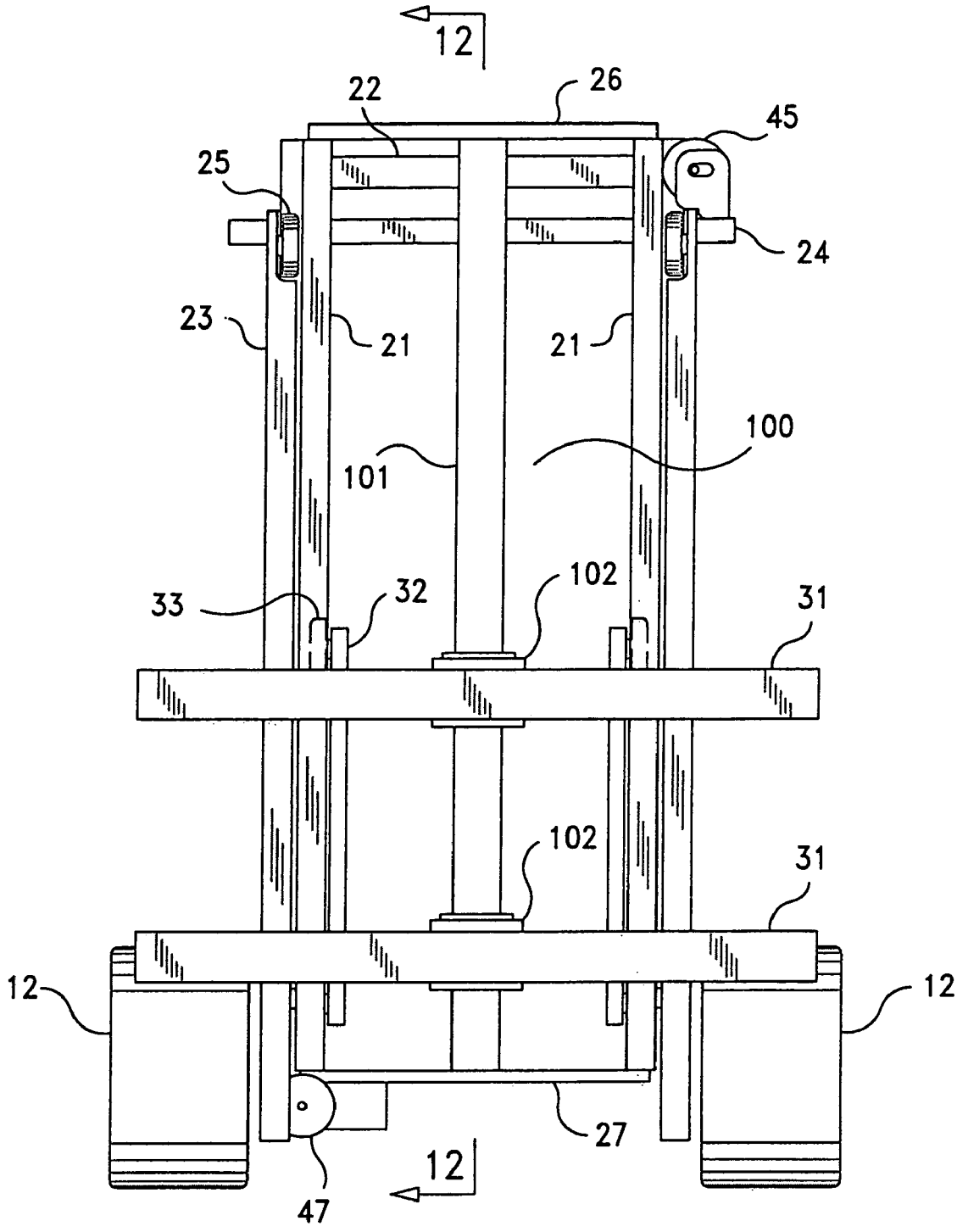
FIG. 11 is a schematic front elevation of another embodiment of a lift truck according to the present invention in which guided members comprise collars which can slide along a post.
Figure 12:
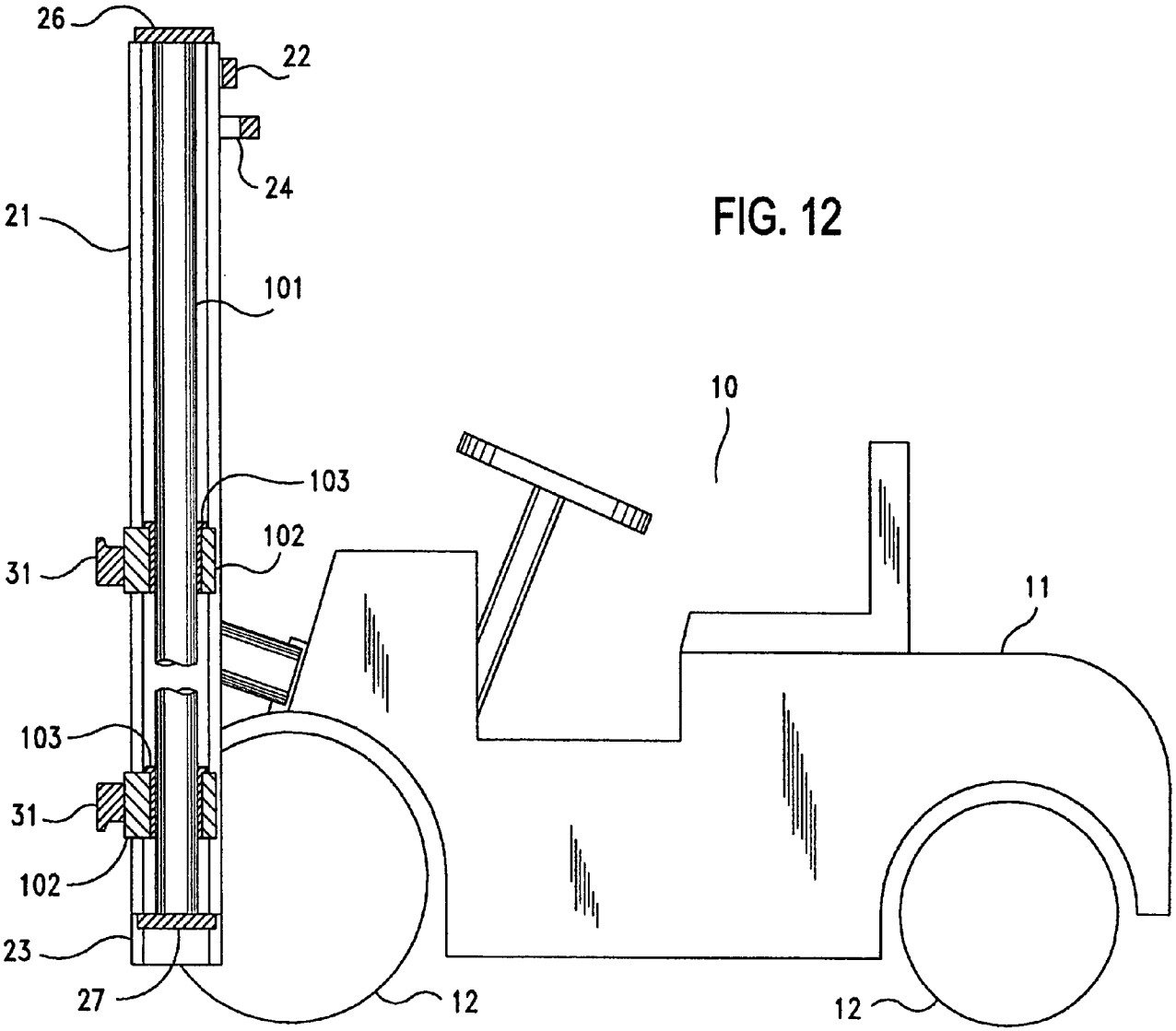
FIG. 12 is a schematic cross-sectional view taken along line 12—12 of FIG. 11.

FIGS. 11–12 illustrate another embodiment of a lift truck according to the present invention equipped with another guide arrangement 100. FIG. 11 is a schematic front elevation of this embodiment, and FIG. 12 is a schematic cross-sectional view taken along line 12—12 of FIG. 11. The guide arrangement 100 in this embodiment includes a guide member comprising a pipe 101 secured at its upper and lower ends to the upper and lower support plates 26 and 27 and extending parallel to the inner channels 21 of the mast 20 of the lift truck 10. It further includes guided members comprising collars 102 which fit over the pipe 101 and slidably engage the outer surface of the pipe 101. Each collar 102 is secured to one of the mounting bars 31 of the carriage 30 so as to be able to move along the height of the pipe 101 as the carriage 30 is raised and lowered along the mast 20. The collars 102 are not restricted to any particular shape. In this embodiment, each collar 102 comprises a rectangular steel block having a through hole which is large enough to receive the pipe 101 and which has a shape matching the cross-sectional shape of the pipe 101 (in this case, circular). In order to provide smooth movement of the collars 102 with respect to the pipe 101, at least a portion of the pipe 101 or the collars 102 may be made of or lined with a material having good sliding properties. In the present embodiment, each collar 102 is equipped with a flanged cylindrical sleeve 103 which fits inside the hole in the collar 102 and is made of a material with good sliding properties, such as any of the materials described with respect to the lining 93 of the guide channel 91 employed in the preceding embodiment. This embodiment employs two separate collars 102, but they may be combined to form a single collar extending between the mounting bars 31 of the carriage 30. It is also possible to employ more than two collars 102.

As with the guide arrangements of the previous embodiments, when a transverse force in the widthwise direction of the lift truck 10 or a moment about an axis extending in the fore-and-aft direction of the lift truck 10 acts on the carriage 30, the engagement between the pipe 101 and the collars 102 of the guide arrangement 100 prevents the collars 102 and the carriage 30 to which they are secured from translating in the widthwise direction or twisting about the fore-and-aft axis and thereby keeps the rollers 33 of the carriage 30 aligned with the inner channels 21 of the mast 20 so that the carriage 30 can move smoothly up and down the mast 20.

Except for the structure of the guide arrangement 100, this embodiment may be otherwise the same as the preceding embodiments. A wide variety of attachments for use with a lift truck can be mounted on the carriage 30 of the lift truck 10 in a conventional manner.

In the preceding embodiments, the mast 20 is equipped with a single guide member (41, 81, 91, or 101) disposed approximately along the centerline plane of the lift truck 10. However, the guide member need not be positioned along the centerline plane, and there may be more than one guide member. For example, in the case of a mast having a vertically-extending hydraulic cylinder disposed along the centerline plane between the inner channels of the mast for raising and lowering a carriage (as is frequently the case with a 3-stage mast), a guide member can be installed alongside the hydraulic cylinder in a position spaced in the widthwise direction from the centerline plane, or two guide members can be installed on opposite widthwise sides of the hydraulic cylinder.

Figure 13:
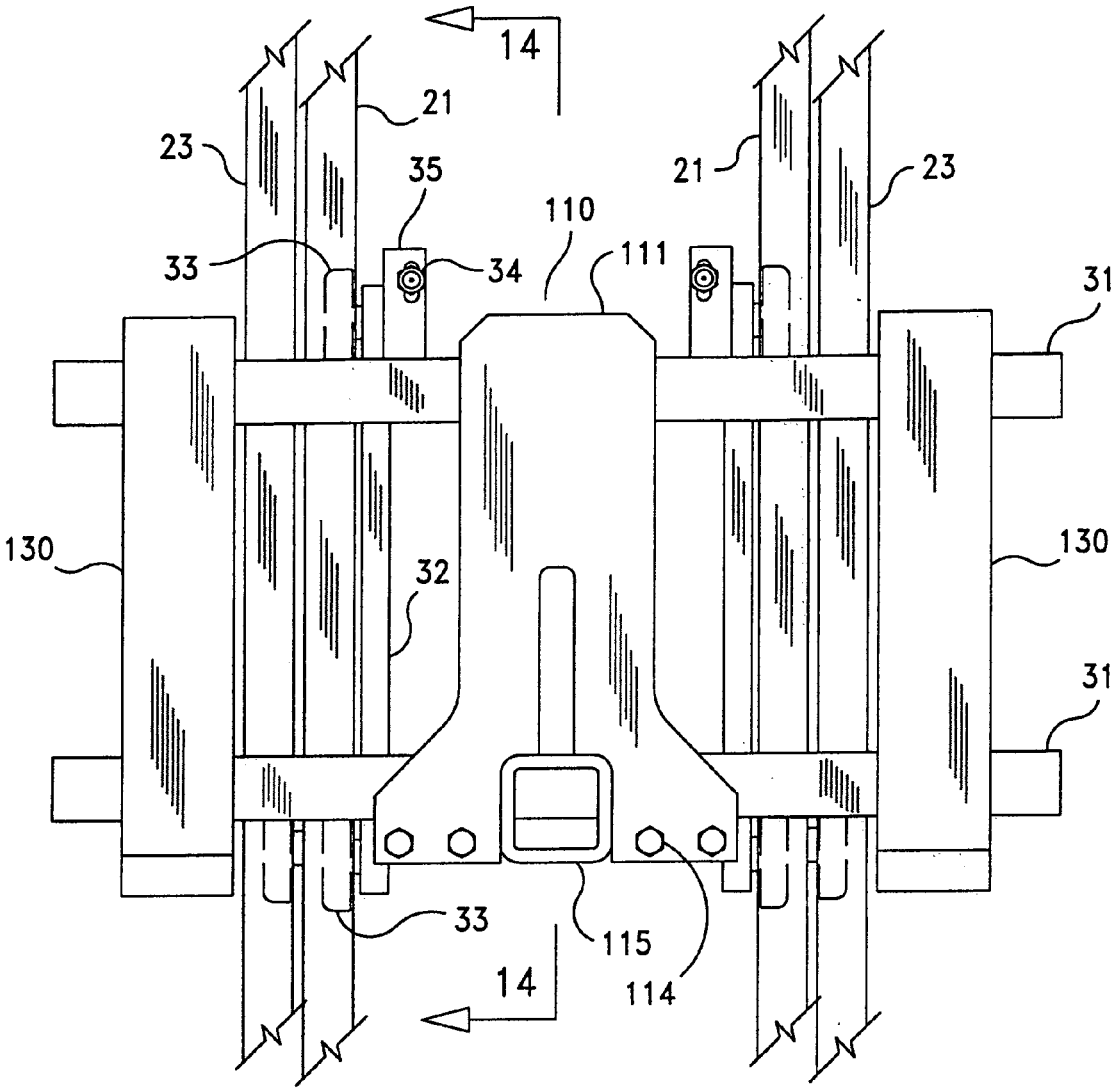
FIG. 13 is a schematic front elevation of a mounting bracket mounted on an embodiment of a lift truck according to the present invention.
Figure 14:
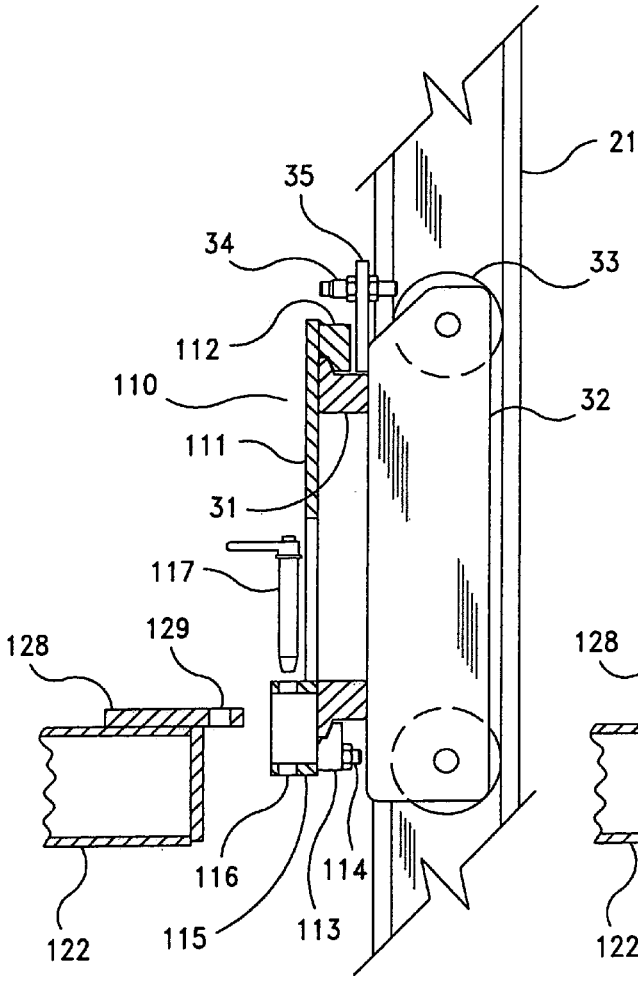
FIG. 14 is a schematic cross-sectional elevation taken along line 14—14 of FIG. 13 showing the state before the mounting bracket has been connected to a clamping apparatus.
Figure 15:
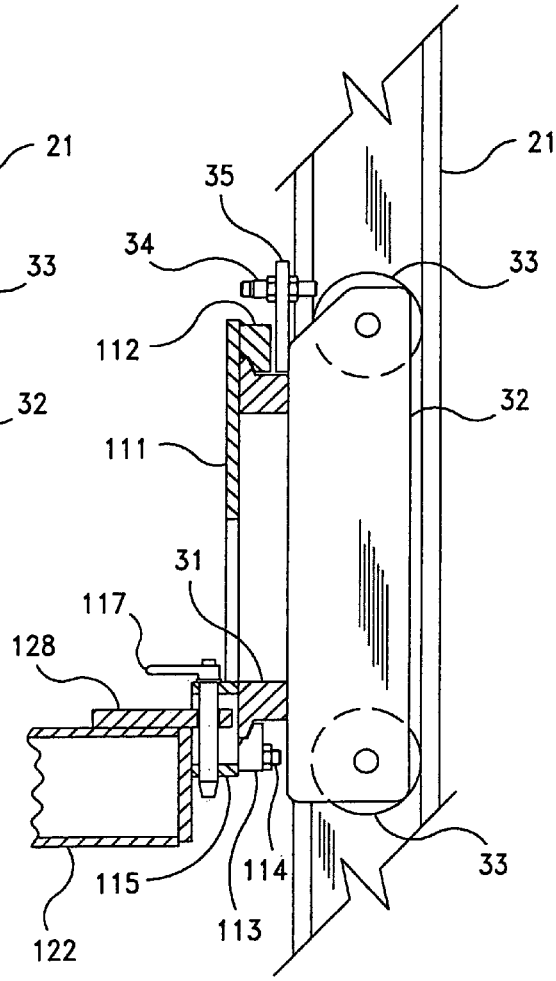
FIG. 15 is a schematic cross-sectional elevation similar to FIG. 14 showing the state after the mounting bracket has been connected to a clamping apparatus.
Figure 16:
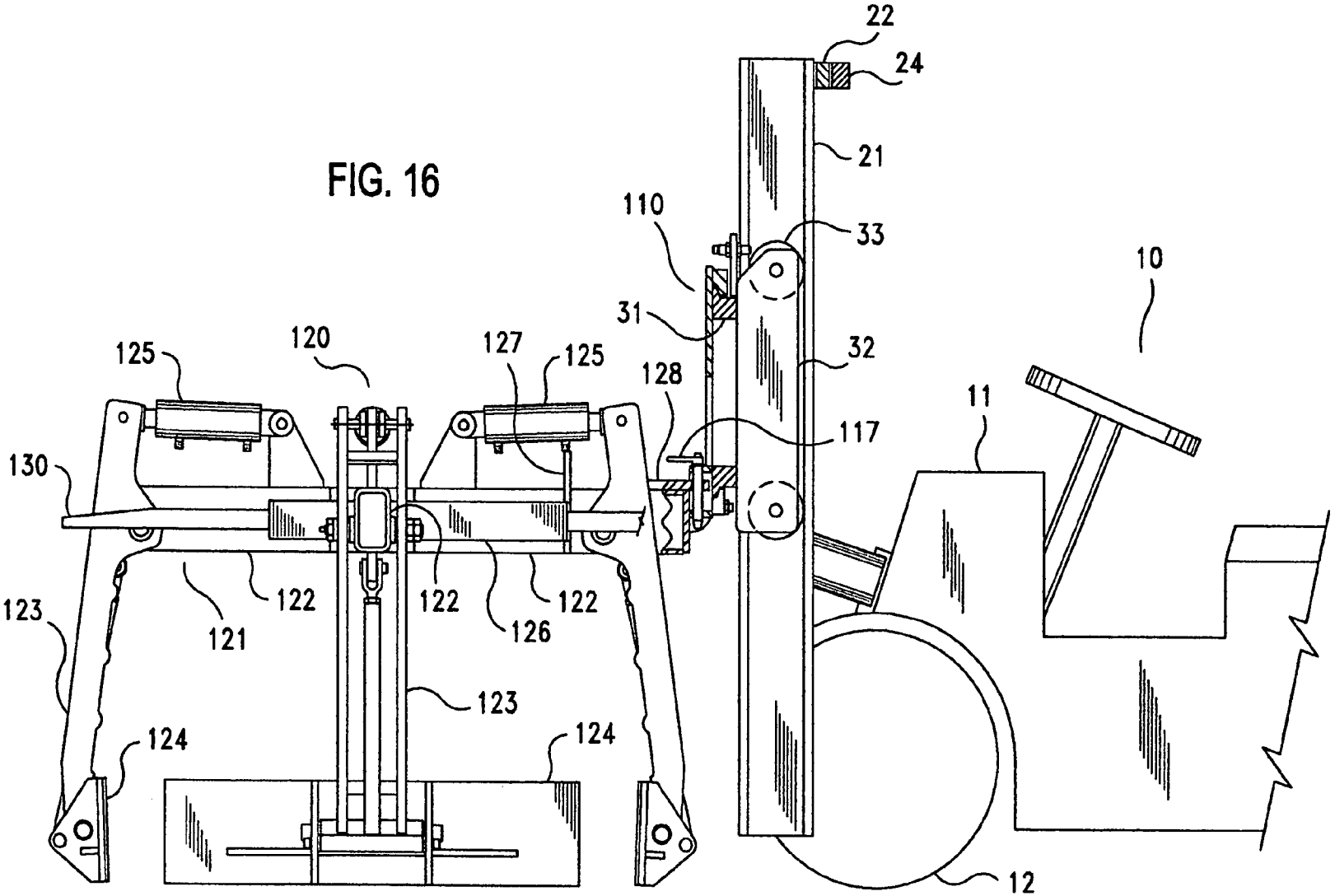
FIG. 16 is a schematic cutaway side elevation of an embodiment of a lift truck according to the present invention connected to a clamping apparatus by the mounting bracket of FIG. 13.
Figure 17:
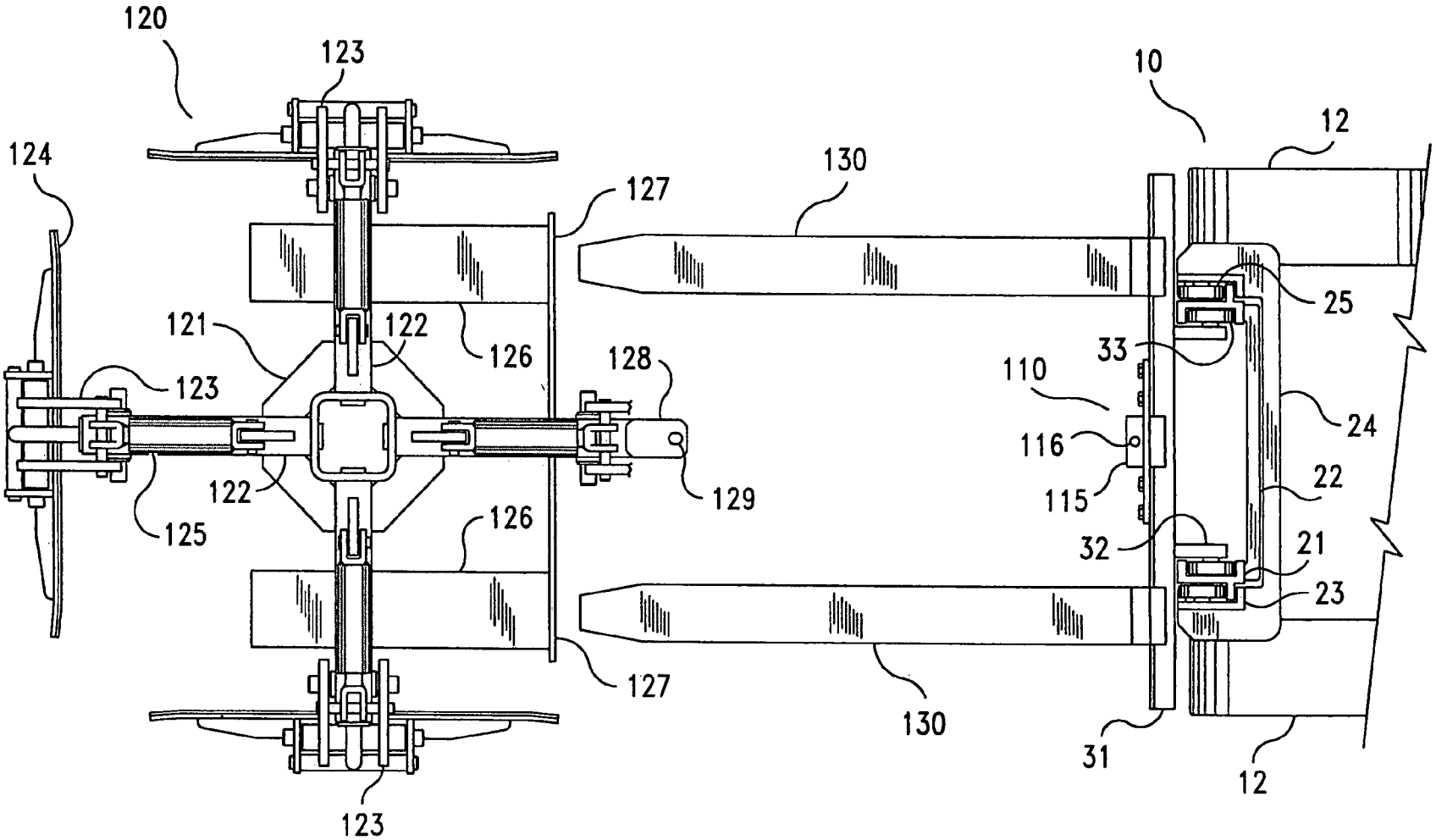
FIG. 17 is a schematic plan view of the lift truck and clamping apparatus of FIG. 16 just before the forks of the lift truck have been engaged with the clamping apparatus.
Figure 18:
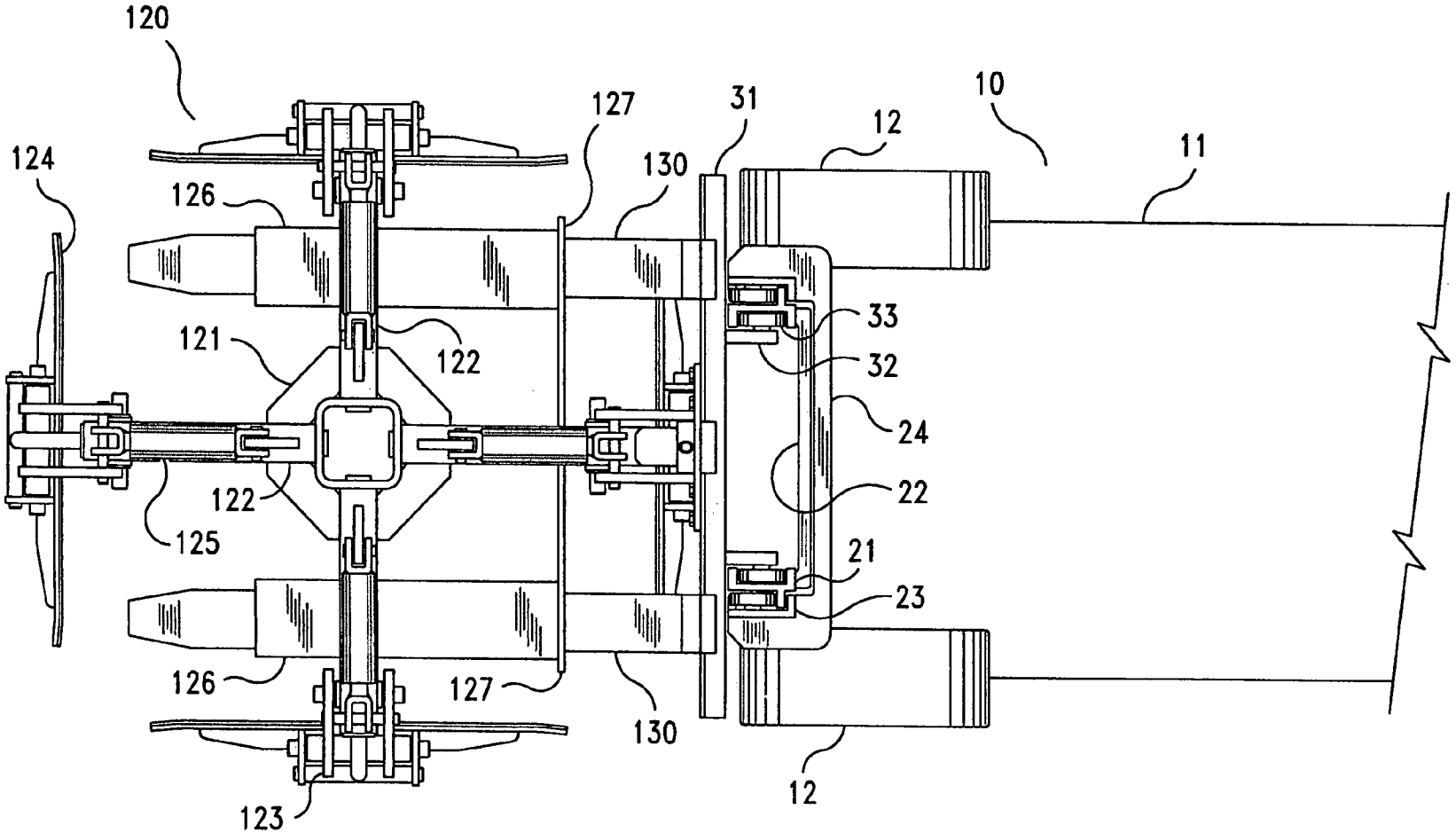
FIG. 18 is a schematic plan view of the lift truck and clamping apparatus of FIG. 16 after the forks of the lift truck have been engaged with the clamping apparatus.
Figure 19:
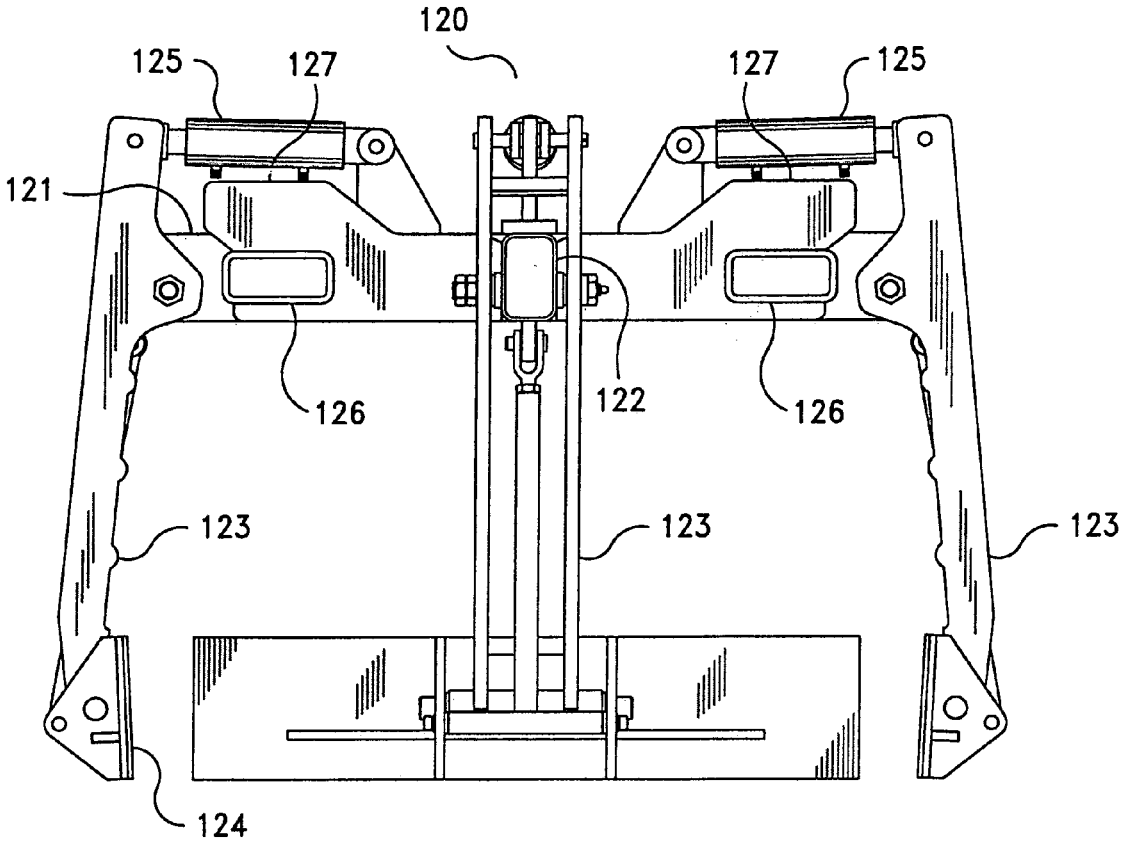
FIG. 19 is a schematic elevation of the clamping apparatus of FIG. 16 as viewed from the right in FIG. 16.

FIGS. 13–19 illustrate an embodiment of a lift truck 10 according to the present invention equipped with a mounting bracket 110 for use in mounting a clamping apparatus on the front of the lift truck 10. FIG. 13 is a schematic front elevation of the mounting bracket 110 mounted on the lift truck 10, FIG. 14 is a schematic cross-sectional view taken along line 14—14 of FIG. 13 showing the state before the mounting bracket has been connected to a clamping apparatus, FIG. 15 is a schematic cross-sectional elevation similar to FIG. 14 showing the state after the mounting bracket has been connected to the clamping apparatus, FIG. 16 is a schematic cutaway side elevation of the lift truck connected to the clamping apparatus by the mounting bracket of FIG. 13, FIG. 17 is a schematic plan view of the lift truck and clamping apparatus of FIG. 16 just before the forks of the lift truck have been engaged with the clamping apparatus, FIG. 18 is a schematic plan view of the lift truck and clamping apparatus of FIG. 16 after the forks of the lift truck have been engaged with the clamping apparatus, and FIG. 19 is a schematic elevation of the clamping apparatus of FIG. 16 as viewed from the right in FIG. 16. The overall structure of the lift truck 10 in this embodiment may be similar to that of the previous embodiments. It includes a body 11 supported by a plurality of wheels 12, a mast 20 mounted on the front of the body 11, and a carriage 30 which can be raised and lowered along the mast 20 by an unillustrated lifting mechanism. Although not shown, if desired, the lift truck 10 may also include a guide arrangement for the carriage 30 and guide rollers 45 and 47 for guiding the inner channels 21 with respect to the outer channels 23 as in any of the preceding embodiments.

The mounting bracket 110 includes a plate 111 having a flange 112 at its upper end which fits over the upper end of the upper mounting bar 31 of the carriage 30. A pair of mounting clips 113 are adjustably connected to the lower end of the plate 111 by bolts 114. The lower mounting bar 31 of the carriage 30 can be clamped between the plate 111 and the mounting clips 113 by tightening the bolts 114. The mounting bracket 110 also includes a mounting tube 115 extending from its front surface. The mounting tube 115 has a pair of aligned holes 116 in opposing sides (here, in its top and bottom sides).

As shown in FIG. 16, the clamping apparatus 120 employed in this embodiment has an overall structure similar to that of the clamping apparatus 60 shown in FIG. 2. It includes a cross-shaped frame 121 having four legs 122 on which are pivotably mounted a plurality of clamping arms 123 each capable of pivoting with respect to the frame 121 to grasp and release a load. The lower end of each clamping arm 123 is equipped with a contact portion 124 for contacting a side of a load to be grasped by the clamping apparatus 120. The clamping arms 123 can be pivoted on the frame 121 by hydraulic cylinders 125 or other suitable actuators. Instead of being connected to a side shifter 50 in the manner shown in FIG. 2, in this embodiment, the clamping apparatus 120 is connected to the mounting bracket 110 of the lift truck 10 by a connecting plate 128 secured to the top surface of the outer end of one of the legs 122 of the clamping apparatus 120. The width of the connecting plate 128 is selected so as to enable the connecting plate 128 to be inserted into the mounting tube 115 of the mounting bracket 110 and overlap the mounting tube 115. The connecting plate 128 includes a hole 129 which can be aligned with the holes 116 in the mounting tube 115. When the holes 116 and 129 in the mounting tube 115 and the connecting plate 128 are in alignment, the connecting plate 128 can be connected to the mounting tube 115 by passing a detachable pin 117, such as a quick-release pin, through the aligned holes.

As shown in FIG. 13, standard forks 130 for use with a lift truck can be mounted on the mounting bars 31 of the carriage 30 on opposite sides of the bracket 110. The mounting bracket 110 does not interfere with the operation of the forks 130, so the mounting bracket 110 can be left on the carriage 30 when the mounting bracket 110 is not in use.

The clamping apparatus 120 can be supported by the lift truck 10 in any desired manner. In the present embodiment, the weight of the clamping apparatus 120 is supported by the forks 130 of the lift truck 10. As shown in FIGS. 16–19, two of the legs 122 of the frame 121 of the clamping apparatus 120 are each equipped with a fork engaging member comprising a tube 126 extending horizontally in a direction perpendicular to the leg 122 on which it is mounted and parallel to another of the legs 122. Each tube 126 is secured to the leg 122 on which it is mounted by welding or other suitable method, or it may be integrally formed with the leg 122. The tubes 126 may be reinforced along their lengths, such as at one end thereof, by reinforcing members such as support plates 127 extending between one of the legs 122 of the frame 121 of the clamping apparatus 120 and the tubes 126 and secured to the leg 122 and the tubes 126. Each of the illustrated tubes 126 extends through the leg 122 on which it is mounted, but it may be located on the exterior of a leg 122, such as on the top or bottom side of a leg 122, without passing through the leg 122. Instead of there being a single tube 126 mounted on a leg 122 and extending through the leg 122, two tubes can be mounted on opposite sides of a leg 122 in alignment with each other and can communicate with each other through holes formed in the leg 122. Each tube 126 has internal dimensions such that the horizontal portion of one of the forks 130 mounted on the lift truck 10 can be inserted into the tube 126.

FIGS. 17 and 18 are schematic plan views of the lift truck 10 and the clamping apparatus 120, showing how the clamping apparatus 120 is mounted on the lift truck 10. As shown in FIG. 17, with the clamping apparatus 120 resting on a floor or other surface, the lift truck 10 is maneuvered so that each fork 130 of the lift truck 10 is aligned with one of the tubes 126 of the clamping apparatus 120. The lift truck 10 is then driven forward to insert each fork 130 into a corresponding one of the tubes 126. The lift truck 10 continues to move forward to the state shown in FIG. 18 in which the connecting plate 128 of the clamping apparatus 120 is inserted into the mounting tube 115 of the mounting bracket 110. A connecting pin 117 is then inserted through the holes 116 and 129 of the mounting tube 115 and the connecting plate 128 to secure the clamping apparatus 120 to the mounting bracket 110. The clamping apparatus 120 can then be raised off the floor by raising the carriage 30 of the lift truck 10. As shown in FIG. 18, when the clamping apparatus 120 has been connected to the lift truck 10, the clamping apparatus 120 can be compactly arranged with respect to the forks 130 in close proximity to the mast 20 of the lift truck 10, with one or more of the clamping arms 123 of the clamping apparatus 120 disposed between the forks 130. When the clamping apparatus 120 is raised off the floor, preferably substantially the entire weight of the clamping apparatus 120 (and any load grasped by it) is supported by the forks 130 engages with the tubes 126 of the clamping apparatus 120. The mounting bracket 110 preferably does not support any significant portion of the weight of the clamping apparatus 120 and instead restrains the clamping apparatus 120 against movement with respect to the forks 130 in the fore-and-aft direction of the lift truck 10 during use or transport of the clamping apparatus 120. For example, the engagement between the mounting bracket 110 and the clamping apparatus 120 prevents the clamping apparatus 120 from translating by sliding along the forks 130 if the mast 20 and the forks 130 are tilted forwards or backwards during operation of the lift truck 10.

As shown in FIG. 13, in order to facilitate rapid mounting and dismounting of the clamping apparatus 120 with respect to the lift truck 10, the carriage 30 of this embodiment is equipped with one or more quick-disconnect hydraulic fittings 34 secured to the upper mounting bar 31 of the carriage 30 by mounting plates 35. When a clamping apparatus 120 is mounted on a lift truck 10 using the mounting bracket 110, hydraulic lines for the hydraulic cylinders 125 of the clamping apparatus 120 and hydraulic lines leading to the hydraulic system of the lift truck 10 can be connected to opposite ends of the fittings 34 to enable the clamping apparatus 120 to be supplied with hydraulic power.

Figure 20:
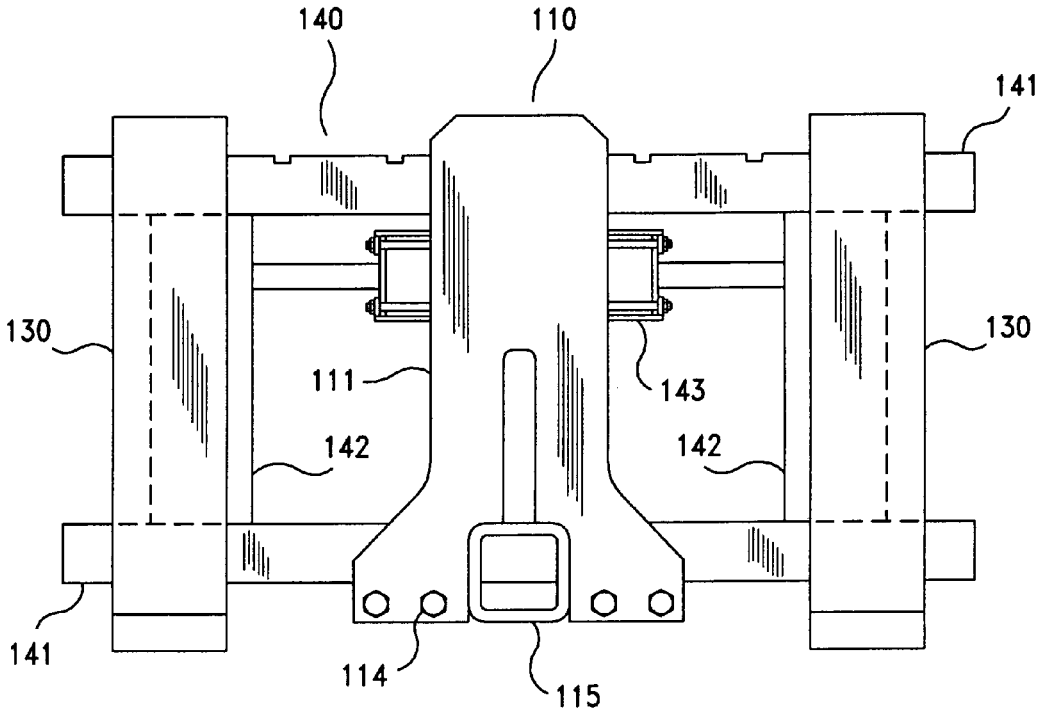
FIG. 20 is a schematic elevation of the mounting bracket of FIG. 13 installed on a side shifter for use with a lift truck.

In the embodiment of FIGS. 13–19, the mounting bracket 110 is mounted directly on the carriage 30 of a lift truck 10, but it may instead be mounted on a different member, such as on a side shifter for use with a lift truck. FIG. 20 is a schematic elevation of the mounting bracket 110 of FIG. 13 mounted on a typical commercially available side shifter 140. The side shifter 140 comprises a rectangular frame including upper and lower horizontal mounting bars 141 and connecting plates 142 extending vertically between the mounting bars 141. It also includes a hydraulic cylinder 143 which can shift the frame to the left and right in the figure with respect to the mast of a lift truck on which the side shifter 140 is mounted. The mounting bars 141 are shaped for supporting various lift truck attachments such as forks 130. On its rear side, the side shifter 140 includes unillustrated fittings by which it can be mounted on a carriage of a lift truck. The mounting bracket 110 and forks 130 can be mounted on the mounting bars 141 of the side shifter 140 in the same manner as they are mounted on the mounting bars 31 of the lift truck carriage 30 in FIG. 13. The forks 130 and the mounting bracket 110 can be engaged with a clamping apparatus 120 in the same manner as in the preceding embodiments. As is the case with FIG. 13, the mounting bracket 110 does not interfere with the operation of the forks 130, so the mounting bracket 110 can be left on the side shifter 140 when the mounting bracket 110 is not being used.

What is claimed is:

1. A mast structure for a lift truck comprising:

a mast comprising a pair of parallel uprights, the mast having a fore-and-aft direction which coincides with a fore-and-aft direction of a lift truck when the mast is mounted on a front end of the lift truck and a widthwise direction extending transversely to the fore-and-aft direction of the mast;

a carriage for supporting a load mounted on the uprights for movement along a height of the mast;

an elongated guide member secured to the mast between the uprights; and a roller mounted on the carriage and having a rotational axis extending in the fore-and-aft direction of the mast and rollable along the guide member and engageable with the guide member as the carriage moves along the mast to resist forces acting on the carriage in the widthwise direction of the mast and moments acting on the carriage about an axis extending in the fore-and-aft direction of the mast.

2. A mast structure as claimed in claim 1 including two rollers mounted on the carriage and spaced from each other in a lengthwise direction of the guide member and rollable along the guide member, each roller having a rotational axis extending in the fore-and-aft direction of the mast.

3. A mast structure as claimed in claim 2 wherein the guide member includes a pair of opposing flanges, and the two rollers are disposed between the opposing flanges.

4. A mast structure as claimed in claim 3 wherein the opposing flanges extend in the fore-and-aft direction of the mast.

5. A mast structure as claimed in claim 3 wherein the guide member comprises a channel having a cavity formed between the opposing flanges and facing towards a front of the mast.

6. A mast structure as claimed in claim 2 wherein the guide member passes between the two rollers.

7. A mast structure as claimed in claim 2 wherein the rollers are disposed on a rear side of the carriage.

8. A lift truck comprising:

a truck body equipped with a plurality of wheels; and a mast structure as claimed in claim 1 mounted on the truck body.

9. A mast structure as claimed in claim 1 wherein the mast comprises a first pair of parallel uprights engaged with the carriage and a second pair of parallel uprights extending parallel to the first uprights and guiding the first pair of uprights for vertical movement with respect to the second pair of uprights, and the guide member is vertically movable together with the first pair of parallel uprights with respect to the second pair of uprights.

10. A mast structure as claimed in claim 9 including two rollers mounted on a rear side of the carriage and spaced from each other in a lengthwise direction of the guide member and rollable along the guide member between a pair of opposing flanges of the guide member, each roller having a rotational axis extending in the fore-and-aft direction of the mast.

11. A mast structure as claimed in claim 1 wherein the mast includes a pair of first uprights disposed parallel to each other, a pair of second uprights disposed parallel to each other on opposite widthwise sides of the first uprights, and a guide roller supported by one of the uprights for rolling contact with another of the uprights and having a rotational axis extending in the fore-and-aft direction of the mast.

12. A mast structure as claimed in claim 11 including a first guide roller disposed at an upper end of one of the second uprights opposing an adjoining one of the first uprights and a second guide roller disposed at a lower end of one of the first uprights opposing an adjoining one of the second uprights.

13. A mast structure as claimed in claim 1 wherein the guide member extends roughly parallel to the uprights approximately midway between the uprights.

* * * * *